United States Patent [19]

Bullock, III

[11] Patent Number: 4,496,066

[45] Date of Patent: Jan. 29, 1985

[54] NECK FINISH FOR PLASTIC CONTAINERS

[75] Inventor: Joseph J. Bullock, III, Atherton, Calif.

[73] Assignee: Three Sisters Ranch Enterprises PTRs, San Carlos, Calif.

[21] Appl. No.: 517,584

[22] Filed: Jul. 27, 1983

[51] Int. Cl.[3] ..... B65D 41/18

[52] U.S. Cl. ..... 215/320; 215/31

[58] Field of Search ..... 215/31, 320

[56] References Cited

U.S. PATENT DOCUMENTS

| | | | |
|---|---|---|---|
| 3,204,799 | 9/1965 | Hunter et al. | 215/31 |
| 3,298,415 | 1/1967 | Klygis | 215/320 X |
| 3,767,076 | 10/1973 | Kennedy | 215/31 X |
| 4,055,267 | 10/1977 | Blair | 215/31 X |
| 4,202,455 | 5/1980 | Faulstich | 215/31 |

FOREIGN PATENT DOCUMENTS

| | | | |
|---|---|---|---|
| 1594812 | 8/1981 | United Kingdom | 215/31 |

*Primary Examiner*—Donald F. Norton
*Attorney, Agent, or Firm*—Julian Caplan

[57] ABSTRACT

A neck finish for plastic containers which are closed by plastic caps of the general type having an integral, thin, flexible inward-directed top flange at the lip which initially slants upwardly-inwardly at an angle of about 20°. When the cap is applied, this top flange fits under the top disc of the cap and is depressed to an angle of about 10°. It nests between the outer skirt and the inner skirt. The neck seals against the outer skirt in several locations (as in prior constructions), but the inner edge of the flange seals tightly in the corner where the bottom of the top disc and the outside of the inner skirt intersect. The top flange also augments the sealing effect of the lower edge of the inner skirt and the inside of the neck. Below the cap skirt the container neck has a shoulder to impede any attempt to pry the cap off the container.

8 Claims, 5 Drawing Figures

NECK FINISH FOR PLASTIC CONTAINERS

This invention relates to a new and improved neck finish for plastic containers. Containers of this type are usually molded of polyethylene by a process known as blow-molding. This process inherently involves difficulties with tolerances and contribute to leakage problems because of variations from the dimensions of the cap used thereon. The flange on the upper end of the neck tends to be rough. Further, shrinkage of the plastic is a problem. The present invention is an improvement upon the structure shown in prior U.S. Pat. No. 4,202,455.

In prior constructions, the in-turned flange at the top of the neck is nominally horizontal and flat. In accordance with the present invention, such flange is tilted upwardly-inwardly. When the cap is applied to the neck, the flange is forced somewhat downwardly, but still retains sufficient resiliency to seal against the underside of the cap disc and, more particularly, seals against the corner where the underside of the disc and the outside of the inner skirt or corking skirt intersect. To facilitate jamming of the inner edge of the flange into the aforesaid corner, the nominal diameter of the flange is made slightly greater than the distance along the underside of the cap disc between the inner edge of the outer skirt and the outer edge of the inner skirt.

Accordingly, the present invention provides two seals in addition to sealing of the locking bead of the exterior of the neck and interior of the outer skirt of the cap. The first such seal is where the inner edge of the top flange of the neck is forced tightly into the corner between the underside of the cap disc and the outside of the inner skirt thereof. Because of the fact that the top flange is forced downwardly when the cap is applied, the upper end of the neck is slightly deformed causing the top internal bead of the neck to be forced inwardly into a tight sealing engagement with the lower edge of the inner or corking skirt of the cap. This is the second seal of the neck and cap.

Another problem encountered in tamper-proof caps of the general class of the present invention is the fact that dishonest patrons sometimes attempt to pry the lower edge of the skirt of the cap and thereby remove the cap from the container neck without tearing the skirt. In accordance with the present invention, there is a narrow horizontal shelf on the exterior of the container neck immediately below the lower edge of the cap skirt. It is difficult for a patron to pry the skirt off the neck by inserting the fingernails under the lower edge of the skirt when the aforesaid shelf is in tight engagement with the lower edge of the skirt.

Other objects of the present invention will become apparent upon reading the following specification and referring to the accompanying drawings in which similar characters of reference represent corresponding parts in each of the several views.

Figure 1:
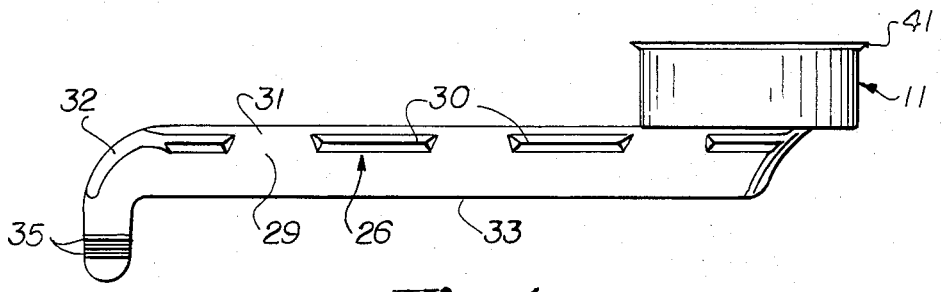
FIG. 1 is a side elevational view of a cap which may be used in accordance with the bottle neck of the present invention with the lower portion of the outer skirt partially torn off to reveal internal construction of the skirt.

The present invention comprises an improvement over U.S. Pat. No. 4,166,552, which is, in turn, an improvement over Pat. No. 3,338,446. The neck construction is used with a bottle cap 11. Although a specific cap 11 is illustrated and described herein, it will be understood that such cap is subject to considerable variation. The neck of the container 12 is also subject to variation to accommodate the particular cap 11 being used. For convenience, the cap will be first described.

Cap 11 comprises a top disc 16 having a planar undersurface 6. Depending from the underside 6 of disc 16 is an interior skirt 17, which is relatively short and has an outwardly-downwardly slanted inner wall 18, a substantially vertical outer wall 19 and an inwardly-downwardly tapered edge 20, which merges with the lower edge of wall 18. There is a corner 7 where the undersurface 6 intersects the outer wall 19.

Outwardly spaced from the inner skirt 17 is outer skirt 21 which has a substantially vertical outer wall 29. The inner wall of skirt 21 has means for securing the cap 11 on the neck of the container 12, such means being subject to certain variations.

The inner wall of outer skirt 21, as illustrated herein, extending downward from disc 16 has a substantially vertical top stretch 22 of a length about equal to that of inner skirt 17, which terminates in an internal bead 23. Below bead 23 is an intermediate vertical wall 24 which terminates in an internal lower bead 26. Bead 26 has slightly downwardly-inwardly slanted top surface 27 which merges with a substantially downwardly-outwardly inclined lower surface 28. The beads 23 and 26 are preferably not continuous (i.e., are not circumferential) but are interrupted. Thus, as shown in FIG. 1, there are gaps 29 between the bead sections 30 of the lower bead 26. The interruptions in the beads permit the skirt to stretch during capping and, hence, permits a thinner wall section for the neck 12. Spaced immediately above the top surface of bead 26, is an internal horizontal scoreline 31 formed on the interior of skirt 21 to permit tearing. Extending upwardly at a slightly spiral configuration is second internal scoreline 32 which extends from the bottom edge 33 of skirt 21 to merge with the horizontal scoreline 31. A tear tab 34, which may be easily gripped with the fingers, depends from the lower edge of skirt 33 immediately to one side of spiral groove 32. To facilitate gripping tab 34, transverse ridges 35 may be formed thereon. The bead 26 is spaced slightly downward from the scoreline 31.

The lower portion of the skirt may be completely torn off, as is explained in the aforementioned patents, leaving a reclosure cap on the upper part of the bottle neck. A thin flexible peripheral flange 41 on top disc 16 may be used to pull the reclosure cap off the neck. The flange 41 is made flexible to thwart efforts to tamper with the contents of the container before the skirt has been torn.

Figure 3:
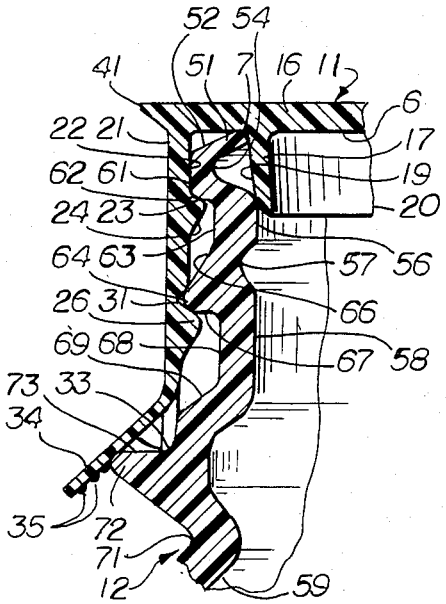
FIG. 3 is a view similar to FIG. 2 showing the cap seated on the neck.
Figure 2:
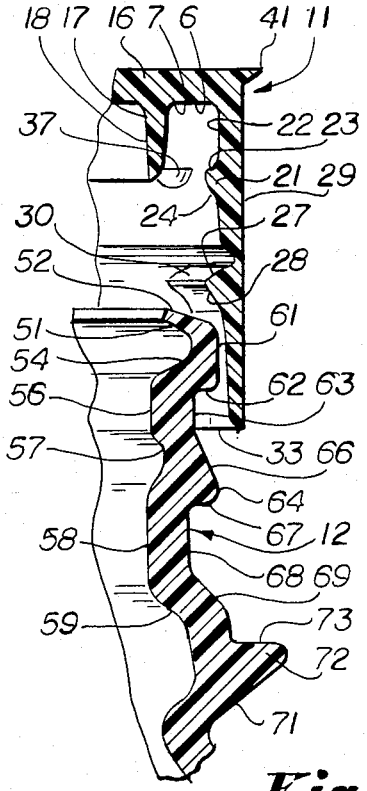
FIG. 2 is an enlarged vertical sectional view through a neck in accordance with the present invention and cap prior to application of the cap to the neck.
Figure 4:
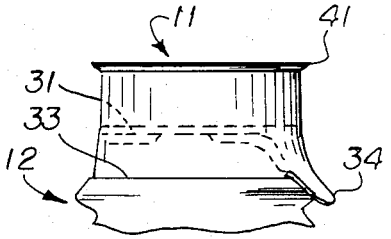
FIG. 4 is a fragmentary side elevational view of a cap seated on a neck in accordance with the present invention.

Directing attention now to the neck of container 12, there is a top inwardly turned flange 51 which, as best shown in FIG. 2, slants upwardly-inwardly at an angle of about 20° in its initial (unstressed) condition. Flange 51 has a flat top surface 52 which is of a width slightly greater than the distance between the inside of the skirt 21 immediately below the disc 16 and the corner 7, hence, when the cap 11 is seated on the neck on the container 12, as hereinafter explained, and as best illustrated in FIG. 3, the flange 51 is depressed to an angle of about 10° and jams between the corner 7 and the interior wall 22 of the outer skirt 21, causing a tight seal of the inner edge of the flange 51 against said corner 7, despite tolerances in the smoothness of molding of the flange 51 and dimensional changes attributable to shrinkage.

Describing, first, the interior of neck 12, proceeding downwardly from flange 51, there is a groove 54 which separates the flange 51 from a second sealing surface 56 which is of lesser diameter than the exterior 19 of the inner skirt 17. By reason of the deformation of the flange 51 when the cap is forced into place, the surface 56 is deformed somewhat inwardly to engage and seal tightly against tapered edge 20 of the interior skirt 17. This is a second sealing area and is, in fact, the first sealing surface which liquid in the container 12 encounters if it were to escape from the sealed container.

Below surface 56 is a second outwardly extending groove 57 and below groove 57 is lower vertical surface 58 which is of lesser diameter than surface 56. Below surface 56 the interior wall 59 of the breast of the neck extends outwardly. In a preferred shape of neck, there is a bumper ring 72 which receives grippers of automatic loading equipment (not shown) in such manner that the grippers do not engage cap 11 and therefore do not tend to remove the cap 11 from the container 12.

Directing attention now to the exterior of neck 12, extending vertically downward from surface 52 is an external first vertical surface 61 which terminates in a sharp angle with horizontal-inwardly extending shoulder 62. The length of surface 61 is such that the bead 23 of the cap 11 in assembled condition seats immediately under the shoulder 62 and holds the cap in place, even when the scoreline 31 has been torn. Thus, the bead 23 and shoulder 62 keep the reclosure cap in place. Below shoulder 62 is second vertical surface 63 which is of substantially lesser diameter than surface 61. Surface 63 terminates in external bead 64. Bead 64 has an outwardly-downwardly slanted upper surface 66 (at about 35° with the horizontal and approximately parallel to surface 28) which is rounded at its outer edge and merges with lower horizontal shoulder 67. Below bead 64 is a third vertical surface 68 which then merges with the external surface of the breast. In the preferred embodiment of the invention shown in FIGS. 2 and 3, there is an external bead 72 on the neck 12 which has a horizontal shoulder 73 immediately under the bottom edge 33 of skirt 21 in the assembled condition shown in FIG. 3.

The fact that the lower edge 33 seats on the shoulder 73 prevents a dishonest patron from using his finger nails to pry the cap 11 off the container 12. In the form of invention shown in FIG. 3, the shoulder 73 extends outwardly beyond the outside diameter of the cap 11. Hence, the tear tab slants outwardly and is conveniently accessible when the user wishes to remove the lower part of the cap 11. As best shown in FIG. 3, the material of construction of the cap 11 is sufficiently flexible so that the bottom edge 33 may seat on the shoulder 73 substantially entirely around the circumference of the cap, yet the area immediately around the upper part of the tab 34 flexes to permit the tab 34 to assume the position shown in FIG. 3.

Figure 3A:
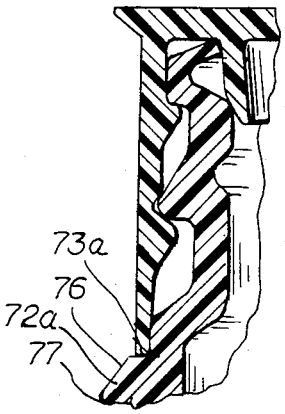
FIG. 3A is a view similar to FIG. 3 showing a modified neck construction.

In FIG. 3A, the structure of the bead 72 is somewhat different from that shown in FIGS. 2 and 3. The horizontal shoulder **73*a* is approximately equal to the thickness of the skirt 21. Outside of the shoulder 73*a*, there is a downwardly-outwardly slanted surface 76 and below the surface 76 is a substantially horizontally inwardly directed surface 77. The narrowness of the shoulder 73*a* and the slanted surface 76 form additional impediments to a dishonest person trying to pry the cap 11*a* off the cap 12*a***.

In assembly of cap 11 on neck 12 (i.e., the downward movement of cap 11 from the position of FIG. 2 to the seated position of FIG. 3), the skirt 21 stretches to permit the lower bead 26 to slide over, first, the corner where the surfaces 52 and 61 intersect and, then, to slide over the bead 64. Similarly, the bead 23 slides over said corner and surface 61. In the seated position of FIG. 3, bead 23 is seated under shoulder 62 and bead 26 is seated under shoulders 67. Accordingly, there are pluralities of sealing surfaces which prevent leakage of liquid from the container 12. The first such sealing surface is where the surface 56 engages the surface 20. The second such sealing surface is where the inner edge of the flange 51 engages the corner 7. An additional sealing surface is where the bead 23 engages the surface 62. A third such sealing surface is where the bead 26 engages the bead 64.

Until the outer skirt 21 is torn, cap 11 cannot be removed from bottle neck 12 without deforming the neck 12. Hence, tampering with the contents of the container is easily detected. Flange 41 flexes to prevent prying off the cap. Furthermore, the bottom edge 33 engages the shoulder 73 or **73*a* to deter inserting the finger nails or a prying instrument under the cap 11**.

When the user wishes to open the container, he first grips the tab 34, (which gripping is facilitated in the form of the invention shown in FIG. 3 by the outward extending bead 72) and pulls upwardly, causing the skirt to tear along the scoreline 32. The user than pulls the tab 34 outwardly away from the neck 12, causing the skirt to tear along the scoreline 31 so that the entire tear strip below groove 31 is removed. To open the bottle, the user then pries up on the flange 41, causing the bead 23 to snap outside the shoulder 62. Although flange 41 is flexible to permit use thereof to pry off the cap when skirt 31 is intact, it is sufficiently rigid to be used to pry off the reclosure cap remaining after the portion of skirt 21 below tear line 31 has been removed. Reclosure is performed merely by pushing downward on cap 11 until the bead 23 seats under the shoulder 62.

What is claimed is:

1. In combination, a neck for a container formed of a flexible plastic material comprising a straight, thin top flange extending inward from the upper end of said neck, said flange slanting upwardly at an acute angle of approximately 20° from the horizontal, first locking means on said neck below said flange, a cap having a disc, an inner and an outer skirt depending from said disc, second locking means on said outer skirt cooperable with said first locking means, whereby when said first and second locking means are engaged said flange is depressed and seals against the underside of said disc, said flange being dimensioned and positioned to slant upward-inward into the annular space between said skirts with the inner edge of said flange fitting tightly into the corner where the outside of said inner skirt intersects the underside of said disc.

2. A combination according to claim 1 in which the upper end of said neck has a short vertical external surface below said flange, the inside of said neck being formed with an internal groove below said flange to increase the flexibility of said flange, the interior of said outer skirt being formed with internal bead means forming part of said second locking means, the lower edge of said short, vertical external surface fitting tightly against the inside of said skirt immediately above said internal bead means, said internal bead means restraining said lower edge against downward movement.

3. A combination according to claim 1 in which said neck is formed with an outward extending external shoulder positioned immediately below the lower edge of said outer skirt when said first and second locking means are engaged to deter prying said cap off said neck by pushing up on the lower edge of said skirt.

4. A combination according to claim 3 in which the width of said shoulder is slightly greater than the thickness of said outer skirt and said neck slants away from said cap below said shoulder.

5. In combination, a neck for a container formed of a flexible plastic material comprising a straight, thin top flange extending inward from the upper end of said neck, said flange slanting upwardly at an acute angle of approximately 20° from the horizontal, first locking means on said neck below said flange, a cap having a disc, an inner and an outer skirt depending from said disc, second locking means on said outer skirt cooperable with said first locking means, whereby when said first and second locking means are engaged said flange is depressed and seals against the underside of said disc, said flange being dimensioned and positioned to slant upward-inward into the annular space between said skirts with the inner edge of said flange fitting tightly against the outer surface of said inner skirt.

6. A combination according to claim 5 in which the upper end of said neck has a short vertical external surface below said flange, the inside of said neck being formed with an internal groove below said flange to increase the flexibility of said flange, the interior of said outer skirt being formed with internal bead means forming part of said second locking means, the lower edge of said short, vertical external surface fitting against the inside of said skirt immediately above said internal bead means, said internal bead means restraining said lower edge against downward movement.

7. A combination according to claim 5 in which said neck is formed with an outward extending external shoulder positioned immediately below the lower edge of said outer skirt when said first and second locking means are engaged to deter prying said cap off said neck by pushing up on the lower edge of said skirt.

8. A combination according to claim 7 in which the width of said shoulder is slightly greater than the thickness of said outer skirt and said neck slants away from said cap below said shoulder.

* * * * *

US004496066B1

REEXAMINATION CERTIFICATE (3482nd)

United States Patent [19] [11] B1 4,496,066

Bullock, III [45] Certificate Issued Apr. 14, 1998

[54] NECK FINISH FOR PLASTIC CONTAINERS

[75] Inventor: Joseph J. Bullock, III, Atherton, Calif.

[73] Assignee: Portola Packaging, Inc., San Jose, Calif.

Reexamination Request:
No. 90/003,230, Oct. 27, 1993

Reexamination Certificate for:

| | |
|---|---|
| Patent No.: | **4,496,066** |
| Issued: | **Jan. 29, 1985** |
| Appl. No.: | **517,584** |
| Filed: | **Jul. 27, 1983** |

[51] Int. Cl.[6] ..... B65D 41/18

[52] U.S. Cl. ..... 215/320; 215/43; 215/45; 215/901

[58] Field of Search ..... 215/254, 256, 215/31, 224, 225, 317, 320, 321, 43, 45, 901

[56] References Cited

U.S. PATENT DOCUMENTS

| | | | |
|---|---|---|---|
| 3,204,799 | 9/1965 | Hunter et al. . | |
| 3,622,028 | 11/1971 | Lohrer | 215/321 X |
| 3,940,004 | 2/1976 | Faulstich . | |
| 4,162,736 | 7/1979 | Faulstich | 215/256 |
| 4,166,552 | 9/1979 | Faulstich | 215/256 |
| 4,177,906 | 12/1979 | Von Hagel . | |
| 4,202,455 | 5/1980 | Faulstich . | |
| 4,305,517 | 12/1981 | Dennis | 215/256 |
| 4,384,654 | 5/1983 | Hospes | 215/256 |
| 4,385,708 | 5/1983 | Curry | 215/256 |
| 4,387,818 | 6/1983 | Conti | 215/256 |
| 4,438,857 | 3/1984 | Bullok, III | 215/256 |
| 4,484,687 | 11/1984 | Bullock, III | 215/256 |
| 4,593,830 | 6/1986 | Bullock | 215/256 |
| 4,625,876 | 12/1986 | Bullock, III | 215/256 |
| 4,691,834 | 9/1987 | Bullock, III | 215/232 |
| 4,699,287 | 10/1987 | Bullock | 215/256 |

FOREIGN PATENT DOCUMENTS

| | | | |
|---|---|---|---|
| 2313278 | 12/1976 | France | 215/256 |

OTHER PUBLICATIONS

Declaration of Stanley Stephenson.

*Primary Examiner*—Allan M. Shoop

[57] ABSTRACT

A neck finish for plastic containers which are closed by plastic caps of the general type having an integral, thin, flexible inward-directed top flange at the lip which initially slants upwardly-inwardly at an angle of about 20°. When the cap is applied, this top flange fits under the top disc of the cap and is depressed to an angle of about 10°. It nests between the outer skirt and the inner skirt. The neck seals against the outer skirt in several locations (as in prior constructions), but the inner edge of the flange seals tightly in the corner where the bottom of the top disc and the outside of the inner skirt intersect. The top flange also augments the sealing effect of the lower edge of the inner skirt and the inside of the neck. Below the cap skirt the container neck has a shoulder to impede any attempt to pry the cap off the container.

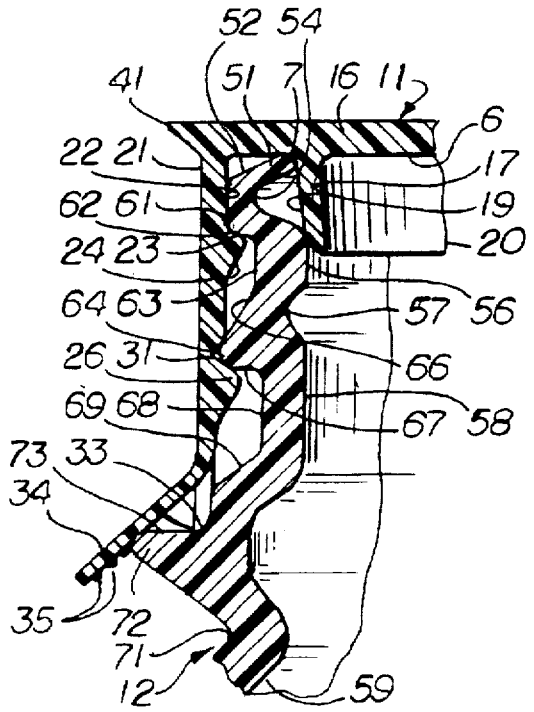

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 6 are cancelled.

Claims 1 and 5 are determined to be patentable as amended.

Claims 3, 4, 7 and 8, dependent on an amended claim, are determined to be patentable.

1. In combination, a neck for a container formed of a flexible plastic material comprising a straight, thin top flange extending inward from the upper end of said neck, said flange slanting upwardly at an acute angle of approximately 20° from the horizontal, first locking means on said neck below said flange, a cap having a disc, an inner and an outer skirt depending from said disc, second locking means on said outer skirt cooperable with said first locking means, whereby when said first and second locking means are engaged said flange is depressed and seals against the underside of said disc, said flange being dimensioned and positioned to slant upward-inward into the annular space between said skirts with the inner edge of said flange fitting tightly into the corner where the outside of said inner skirt intersects the underside of said disc, *said upper end of said neck having a short vertical external surface immediately below said flange, the inside of said neck being formed opposite said short vertical external surface with an internal groove immediately below said flange to increase the flexibility of said flange, the exterior of said neck being formed with a substantially horizontal, inwardly directed shoulder immediately below said short vertical external surface, the interior of said outer skirt being formed with internal bead means forming part of said second locking means, said internal bead means having an upper surface immediately below said short vertical external surface which engages under said shoulder, the lower edge of said short, vertical external surface fitting tightly against the inside of said skirt immediately above said internal bead means, said internal bead means restraining said lower edge against downward movement.*

5. In combination, a neck for a container formed of a flexible plastic material comprising a straight, thin top flange extending inward from the upper end of said neck, said flange slanting upwardly at an acute angle of approximately 20° from the horizontal, first locking means on said neck below said flange, a cap having a disc, an inner and an outer skirt depending from said disc, second locking means on said outer skirt cooperable with said first locking means, whereby when said first and second locking means are engaged said flange is depressed and seals against the underside of said disc, said flange being dimensioned and positioned to slant upward-inward into the annular space between said skirts with the inner edge of said flange fitting tightly against the outer surface of said inner skirt, *said upper end of said neck having a short vertical external surface immediately below said flange, the inside of said neck being formed opposite said short vertical external surface with an internal groove immediately below said flange, the interior of said neck being formed with a substantially horizontal, inwardly directed surface immediately below said short vertical external shoulder, the interior of said outer skirt being formed with internal bead means forming part of said second locking means, said internal bead means having an upper surface immediately below said short vertical external surface which engages under said shoulder, the lower edge of said short, vertical external surface fitting against the inside of said skirt immediately above said internal bead means, said internal bead means restraining said lower edge against downward movement.*

* * * * *